US005346326A

United States Patent [19]

Bienvenu

[11] Patent Number: 5,346,326

[45] Date of Patent: Sep. 13, 1994

[54] VIDEO GUIDE

[76] Inventor: Donald J. Bienvenu, 1311 W. "I" St., Wilmington, Calif. 90744

[21] Appl. No.: 99,424

[22] Filed: Jul. 30, 1993

[51] Int. Cl.[5] ..... B42F 13/00

[52] U.S. Cl. ..... 402/79; 281/15.1; 281/31; 281/38

[58] Field of Search ..... 402/79, 70, 73, 75, 402/80; 281/15.1, 21.1, 31, 38

[56] References Cited

U.S. PATENT DOCUMENTS

| | | | |
|---|---|---|---|
| 4,575,126 | 3/1986 | Grubbs | 281/31 X |
| 4,915,522 | 4/1990 | Greathouse | 402/79 |
| 4,973,184 | 11/1990 | La Salle | 402/70 |
| 5,123,676 | 6/1992 | Donnelly et al. | 402/73 |

*Primary Examiner*—Mark Rosenbaum
*Assistant Examiner*—Willmon Fridie, Jr.
*Attorney, Agent, or Firm*—Michael I. Kroll

[57] ABSTRACT

A video guide is provided which consists of a binder and a plurality of data pages held within the binder for listing and keeping track of video cassette tapes that are rented and bought.

11 Claims, 2 Drawing Sheets

| | | |
|---|---|---|
| 58 TITLE | 60 | TAPE NO. |
| 56 | 64 | YEAR MADE |
| 62 ACTOR(S) | 66 | DATE RENTED |
| | 68 | TIME HR. MIN. 70 |
| 72 SUBJECT Animated ( ) Fantasy ( ) Sports ( ) Sci Fi ( ) | | COUNTER |
| Adventure ( ) Biography ( ) Comedy ( ) Drama ( ) Thriller ( ) X Rated ( ) | | |
| 74 RATING General Audiences ( ) Parental Guidance ( ) Adult Viewing ( ) | | |

| | |
|---|---|
| TITLE | TAPE NO. |
| | YEAR MADE |
| ACTOR(S) | DATE RENTED |
| 56 | TIME HR. MIN. |
| SUBJECT Animated ( ) Fantasy ( ) Sports ( ) Sci Fi ( ) | COUNTER |
| Adventure ( ) Biography ( ) Comedy ( ) Drama ( ) Thriller ( ) X Rated ( ) | |
| RATING General Audiences ( ) Parental Guidance ( ) Adult Viewing ( ) | |

| | |
|---|---|
| TITLE | TAPE NO. |
| | YEAR MADE |
| ACTOR(S) | DATE RENTED |
| 56 | TIME HR. MIN. |
| SUBJECT Animated ( ) Fantasy ( ) Sports ( ) Sci Fi ( ) | COUNTER |
| Adventure ( ) Biography ( ) Comedy ( ) Drama ( ) Thriller ( ) X Rated ( ) | |
| RATING General Audiences ( ) Parental Guidance ( ) Adult Viewing ( ) | |

| | |
|---|---|
| TITLE | TAPE NO. |
| 56 | YEAR MADE |
| ACTOR(S) | DATE RENTED |

14

Fig. 6

VIDEO GUIDE

BACKGROUND OF THE INVENTION

1. Field of the Invention

The instant invention relates generally to record keeping books and more specifically it relates to a video guide.

2. Description of the Prior Art

Numerous record keeping books have been provided in prior art that are adapted to organize information needed by people in business and at home. While these units may be suitable for the particular purpose to which they address, they would not be as suitable for the purposes of the present invention as heretofore described.

SUMMARY OF THE INVENTION

A primary object of the present invention is to provide a video guide that will overcome the shortcomings of the prior art devices.

Another object is to provide a video guide that is a binder constructed to hold data pages for listing and keeping track of video cassette tapes that are rented and bought.

An additional object is to provide a video guide that comes with adhesive rectangular labels and adhesive circular number stickers which can be applied to the actual video cassette tapes, so that the tapes can be correlate to the information placed upon the data pages in the binder.

A further object is to provide a video guide that is simple and easy to use.

A still further object is to provide a video guide that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the instant invention in a closed position.

FIG. 2 a perspective view of the instant invention with parts broken away in an opened position at the memo pages at the back of the binder.

FIG. 6 is an enlarged plan view of a portion of a typical data page which is placed within the binder.

DETAILED DESCRIPTION OF THE PREFERRED EMBODIMENTS

Figure 1:
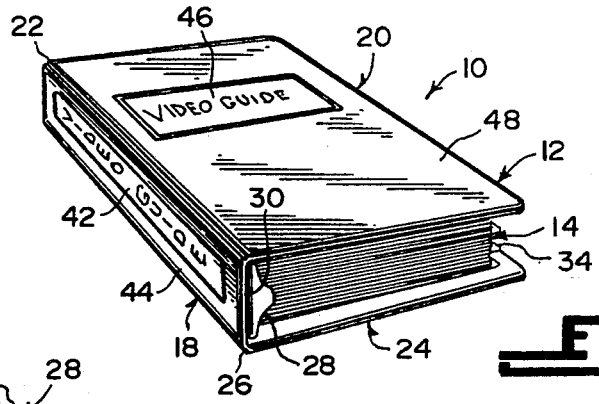
Figure 2:
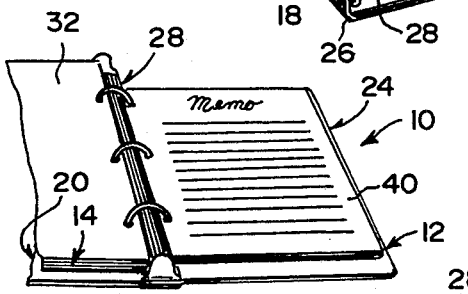
Figure 3:
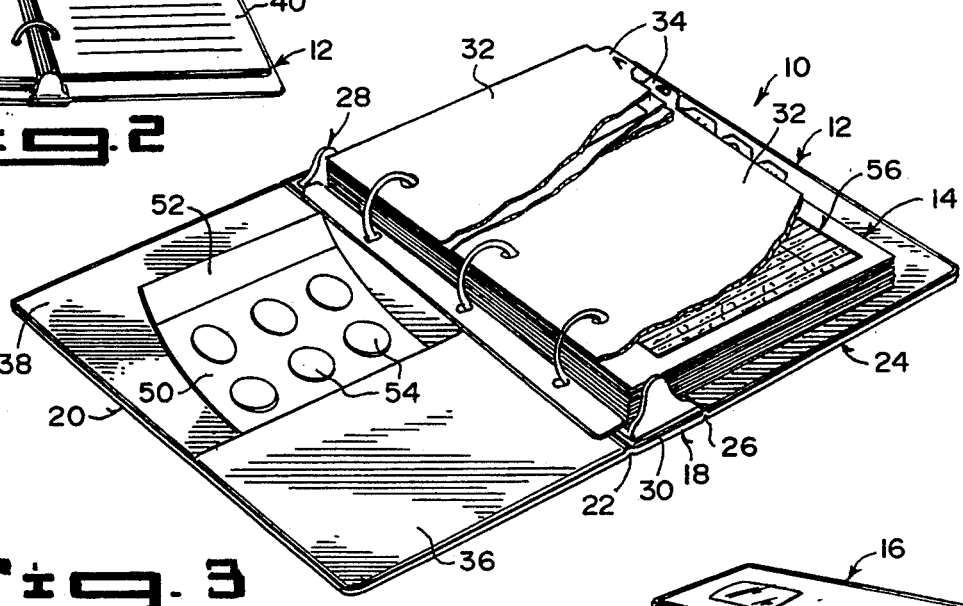
FIG. 3 is a perspective view of the instant invention with parts broken away in an opened position at the data pages at the front of the binder.
Figure 4:
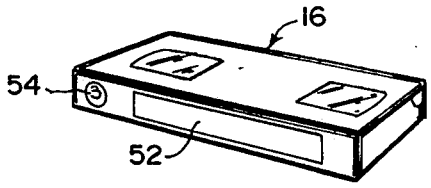
FIG. 4 is a perspective view of a video cassette tape with an adhesive label and an adhesive number tab applied thereto, for identification wit the information placed onto one of the data pages.
Figure 5:
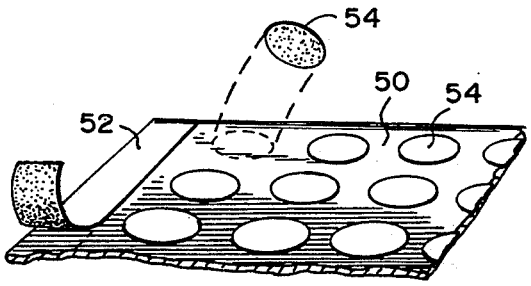
FIG. 5 is a perspective view of a portion of an application sheet with the adhesive label and adhesive number tabs thereon.

Turning now descriptively to the drawings, in which similar reference characters denote similar elements throughout the several views, FIGS. 1 through 6 illustrate a video guide 10, which consists of a binder 12 and a plurality of data pages 14 held within the binder 12, for listing and keeping rack of video cassette tapes 16 are rented and bought.

The binder 12 contains a spine 18 with a front cover 20 hinged at 22 to the spine 18. A back cover 24 is also hinged at 26 to the spine 18. A three ring mechanism 28 is mounted on an inner surface 30 of the spine 18, for holding the data pages 14 within the binder 12. A plurality of index dividers 32 are provided, with each having a tab 34 with one letter of the alphabet thereon, so as to arrange in alphabetical order the video cassette tapes 16 listed on the data pages 14.

A pocket 36 is on an inner surface 38 of the front cover 20 for storing notes, cards and similar articles therein. A plurality of memo pages 40 are for keeping track of video cassette tapes 16 to buy, rent and that are loaned out.

A first title box 42 with the words "VIDEO GUIDE" is applied to an outer surface 44 of the spine 18. A second title box 46 with the words "VIDEO GUIDE" is applied to an outer surface 48 of the front cover 20, so that the first and the second title boxes 42, 46 will identify the binder 12.

A plurality of application sheets 50 are provided, with each having at least one adhesive rectangular label 52 and a plurality of adhesive circular number stickers 54, which can be applied to the actual video cassette tapes 16. The tapes can be correlated to the information placed upon the date pages 14 in the binder 12.

As shown in FIG. 6, each data page 14 includes a plurality of information boxes 56, for identifying each of the video cassette tapes 16. Each information box 56 contains a first area 58 with the word "TITLE" printed thereon for listing a name of a movie. A second area 60 with the words "TAPE NO." printed thereon is for assigning a number to a movie. A third area 62 with the word "ACTOR(S)" printed thereon is for listing the starring actors in a movie. A fourth area 64 with the words "YEAR MADE" printed thereon is for listing the year a movie was made.

A fifth area 66 with the words "DATE RENTED" printed thereon is for listing the date a movie was rented. A sixth area 68 with the words "TIME HR. MIN." printed thereon is for listing the length of a movie. A seventh area 70 with the word "COUNTER" printed thereon is for listing the number off of a counter in a video cassette recorder, when a movie is taped from a television receiver. An eighth area 72 with the words "SUBJECT, Animated ( ) Fantasy ( ) Sports ( ) Sci Fi ( ) Adventure ( ) Biography ( ) Comedy ( ) Drama ( ) Thriller ( ) X Rated ( ) printed thereon is for checking off the type of a movie. A ninth area 74 with the words "RATING, General Audiences ( ) Parental Guidance ( ) Adult Viewing ( ) printed thereon is for checking off the rating of a movie.

OPERATION OF THE INVENTION

To use the video guide the following steps should be taken:

1. Turn to the proper data page 14 in the binder 12, such as after the index divider 32 with a tab 34 with the letter "L".

2. In the first area 58 in the information box 56 write in the name of the movie, for example "LETHAL WEAPON".

3. In the second area 60 write in the number assigned to-"3".

4. In the third area 62 write in the actors names-"MEL GIBSON" and "DANNY GLOVER".

5. In the fourth area 64 write in the year the movie was made-"1987".

6. In the fifth area 66 write in the date the movie was rented. If owned leave it blank.

7. In the sixth area 68 write in the length of the movie-"1 HR. 50 MIN.".

8. In the seventh area 70 write in the counter number "325".

9. In the eighth area 72 check off the type of movie "Drama (x)".

10. In the eighth area 74 check off the rating of the movie "Parental Guidance (x)".

LIST OF REFERENCE NUMBERS

10 video guide
12 binder
14 data page
16 video cassette tape
18 spine of 12
20 front cover of 12
22 hinge between 18 and 20
24 back cover of 12
26 hinge between 18 and 24
28 three ring mechanism
30 inner surface of 18
32 index divider
34 tab on 32
36 pocket
38 inner surface of 20
40 memo page
42 first title box
44 outer surface of 18
46 second title box
48 outer surface of 20
50 application sheet
52 adhesive rectangular label

54 adhesive circular number sticker
56 information box on 14
58 first area in 56
60 second area in 56
62 third area in 56
64 fourth area in 56
66 fifth area in 56
68 sixth area in 56
70 seventh area in 56
72 eighth area in 56
74 ninth area in 56

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A video guide which comprises:

a) a binder, said binder including a spine, a front cover hinged to said spine containing a pocket on an inner surface of said front cover for storing notes, cards and similar articles therein, a back cover hinged to said spine, a three ring mechanism mounted on an inner surface of said spine for holding the data pages within said binder;

b) a plurality of data pages held within said binder for listing and keeping track of video cassette tapes that are rented and bought;

c) a plurality of index dividers each having a tab with one letter of the alphabet thereon, so as to arrange in alphabetical order the video cassette tapes listed on said data pages;

d) a pocket on an inner surface of said front cover for storing notes, cards and similar articles therein;

e) a plurality of memo pages for keeping track of video cassette tapes to buy, rent and that are loaned out;

f) a first title box with the words "VIDEO GUIDE" applied to an outer surface of said spine;

g) a second title box with the words "VIDEO GUIDE" applied to an outer surface of said front cover, so that said first and said second title boxes will identify said binder; and h) a plurality of application sheets, each having at least one adhesive rectangular label and a plurality of adhesive circular number stickers which can be applied to the actual video cassette tapes, so that the tapes can be correlated to the information placed upon said data pages in said binder.

2. A video guide as recited in claim 1, wherein each said data page includes a plurality of information boxes for identifying each of the video cassette tapes.

3. A video guide as recited in claim 2, wherein each said information box includes a first area with the word "TITLE" printed thereon for listing a name of a movie.

4. A video guide as recited in claim 3, wherein each said information box includes a second area with the words "TAPE NO." printed thereon for assigning a number to a movie.

5. A video guide as recited in claim 4, wherein each said information box includes a third area with the word "ACTOR(S)" printed thereon for listing the starring actors in a movie.

6. A video guide as recited in claim 5, wherein each said information box includes a fourth area with the words "YEAR MADE" printed thereon for listing the year a movie was made.

7. A video guide as recited in claim 6, wherein each said information box includes a fifth area with the words "DATE RENTED" printed thereon for listing the date a movie was rented.

8. A video guide as recited in claim 7, wherein each said information box includes a sixth area with the words "TIME HR. MIN." printed thereon for listing the length of a movie.

9. A video guide as recited in claim 8, wherein each said information box includes a seventh area with the word "COUNTER" printed thereon for listing the number off of a counter in a video cassette recorder, when a movie is taped from a television receiver.

10. A video guide as recited in claim 9, wherein each said information box includes an eighth area with the words "SUBJECT, Animated ( ) Fantasy ( ) Sports ( ) Sci Fi ( ) Adventure ( ) Biography ( ) Comedy ( ) Drama ( ) Thriller ( ) X Rated ( ) printed thereon for checking off the type of a movie.

11. A video guide as recited in claim 10, wherein each said information box includes a ninth area with the words "RATING, General Audiences ( ) Parental Guidance ( ) Adult Viewing ( )" printed thereon for checking off the rating of a movie.

* * * * *